US008613369B2

(12) United States Patent
Kitto

(10) Patent No.: US 8,613,369 B2
(45) Date of Patent: Dec. 24, 2013

(54) LID RETAINER FOR DRINKING BOTTLE

(76) Inventor: Stephen M. Kitto, Victor, ID (US)

( * ) Notice: Subject to any disclaimer, the term of this patent is extended or adjusted under 35 U.S.C. 154(b) by 101 days.

(21) Appl. No.: 12/931,729

(22) Filed: Feb. 8, 2011

(65) Prior Publication Data

US 2012/0199548 A1 Aug. 9, 2012

(51) Int. Cl.
*B65D 43/03* (2006.01)

(52) U.S. Cl.
USPC ..... 220/379; 220/316; 215/390

(58) Field of Classification Search
USPC ..... 220/744, 212, 379, 386, 390; 215/316, 215/386, 390
See application file for complete search history.

(56) References Cited

U.S. PATENT DOCUMENTS

| | | | | |
|---|---|---|---|---|
| 655,413 | A | 8/1900 | Parkyn | |
| 1,605,195 | A * | 11/1926 | Lewis | 224/148.6 |
| 2,524,972 | A | 10/1950 | Hamilton | |
| 2,672,257 | A | 3/1954 | Simmonds | |
| 2,761,717 | A | 9/1956 | Mahlke | |
| 2,957,596 | A * | 10/1960 | Rehborg | 215/386 |
| 3,228,878 | A | 1/1966 | Moody | |
| 3,402,844 | A | 9/1968 | Chin | |
| 3,961,721 | A | 6/1976 | Gordon | |
| 4,345,704 | A * | 8/1982 | Boughton | 224/414 |
| 4,484,682 | A | 11/1984 | Crow | |
| 4,489,842 | A | 12/1984 | Bobrove | |
| 5,096,154 | A | 3/1992 | Ellis | |
| 5,105,958 | A * | 4/1992 | Patton | 215/388 |
| 5,244,106 | A | 9/1993 | Takacs | |
| 5,299,433 | A | 4/1994 | Harms | |
| 5,331,721 | A * | 7/1994 | Raum, Sr. | 24/3.12 |
| 5,363,745 | A | 11/1994 | Lin | |
| 5,381,922 | A * | 1/1995 | Gladman et al. | 220/481 |
| 5,454,492 | A | 10/1995 | Hunter | |
| 5,542,562 | A | 8/1996 | Oratz | |
| 5,769,680 | A | 6/1998 | Hoffman | |
| 5,988,464 | A * | 11/1999 | Butler et al. | 224/148.4 |
| 6,004,033 | A | 12/1999 | Cirone | |
| 6,036,061 | A | 3/2000 | O'Donnell | |
| 6,065,632 | A | 5/2000 | Moore, Jr. | |
| 6,202,963 | B1 * | 3/2001 | Derman | 248/110 |
| 6,390,319 | B1 | 5/2002 | Yu | |
| 7,107,894 | B2 * | 9/2006 | Janczak et al. | 99/277.1 |

(Continued)

OTHER PUBLICATIONS

Vincero Design; s24 Bottle; www.vincero-design.com.

(Continued)

*Primary Examiner* — Anthony Stashick
*Assistant Examiner* — Christopher McKinley
(74) *Attorney, Agent, or Firm* — Heisler & Associates

(57) ABSTRACT

The retainer includes a coupling pair with a lid portion and a bottle portion. The lid portion is anchored to a lid. The bottle portion is anchored to a bottle. The lid and bottle are removably attachable in a manner opening and closing access into an interior of the bottle. With the lid portion affixed to the lid and the bottle portion affixed to the bottle, the coupling pair can be utilized to secure the lid to the bottle in a position leaving the opening of the bottle clear. In one form the lid portion and bottle portion exhibit magnetic attraction thereto, such as by having one part of the coupling pair in the form of a magnet and the other part in the form of a ferromagnetic material. In one embodiment the entire outer surface of the bottle is formed of ferromagnetic material with the lid portion being a magnet.

17 Claims, 4 Drawing Sheets

(56) References Cited

U.S. PATENT DOCUMENTS

| | | | | |
|---|---|---|---|---|
| 7,172,101 | B2 | 2/2007 | Find | |
| 7,300,580 | B2 | 11/2007 | Lindsey | |
| 7,344,646 | B2 * | 3/2008 | Flick | 210/695 |
| 2006/0037902 | A1 | 2/2006 | Pedersen | |
| 2009/0293238 | A1 | 12/2009 | Davis | |
| 2010/0127006 | A1 | 5/2010 | Krammes | |
| 2010/0127011 | A1 | 5/2010 | Britto | |

OTHER PUBLICATIONS

Vincero Design; edgel6 Carbon Composite Mount; www.vincero-design.com.

* cited by examiner

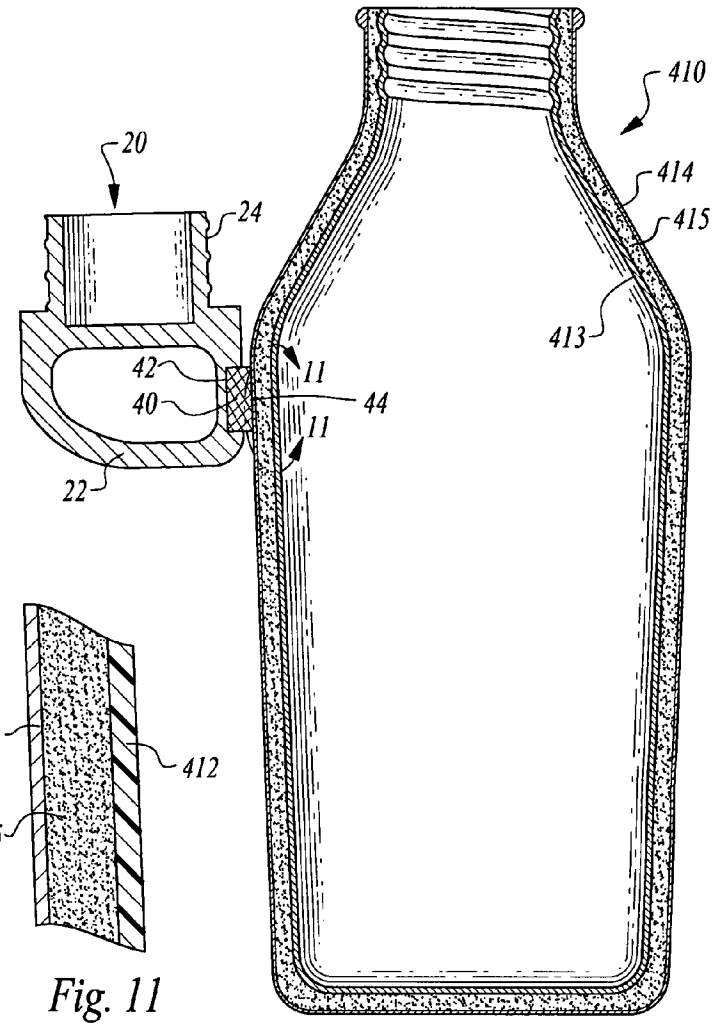
Fig. 10
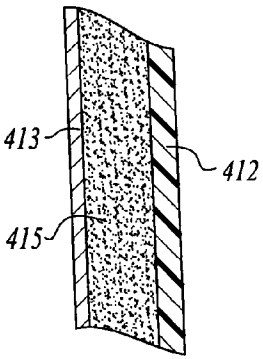
Fig. 11
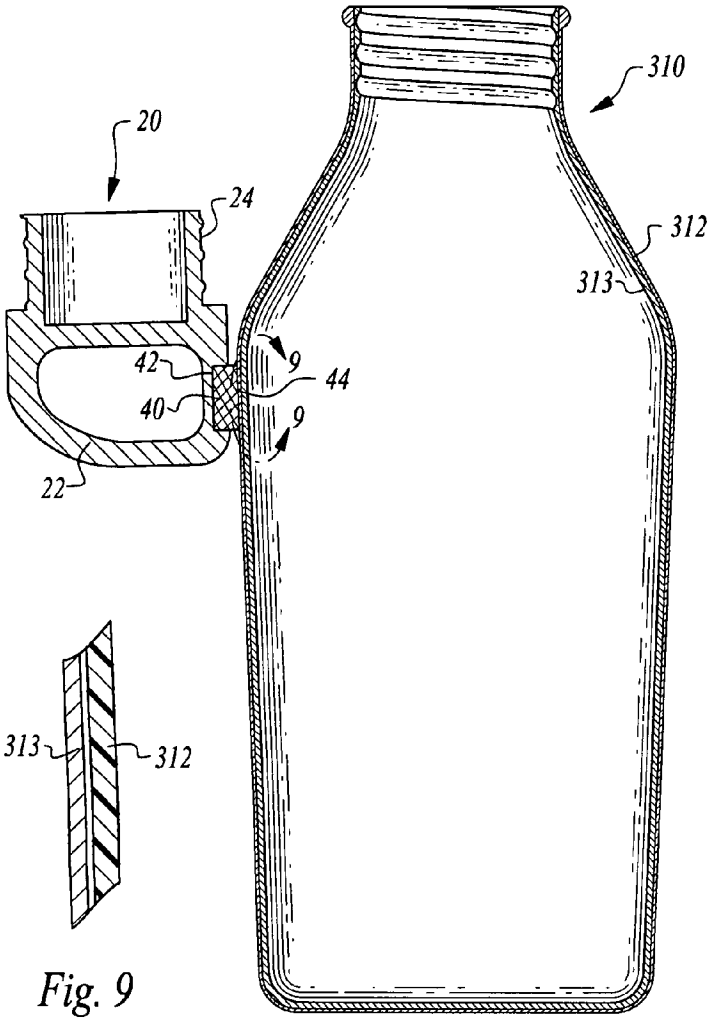
Fig. 8
Fig. 9

LID RETAINER FOR DRINKING BOTTLE

FIELD OF THE INVENTION

The following invention relates to drinking bottles including lids for selectively opening and closing access to an interior of the bottle. More particularly, this invention relates to lidded drinking bottles which include an auxiliary coupling system for retaining the lid to the drinking bottle when the lid is in a position other than closing an opening in the drinking bottle, such as to hold the lid in place adjacent the bottle when the bottle is being used for drinking.

BACKGROUND OF THE INVENTION

Drinking bottles take on a variety of different configurations. Some bottles are disposable while others are reusable. Generally it is desirable to have a reusable bottle in that a more sustainable product is provided, minimizing the requirement for recycling methods to be implemented to efficiently utilize a bottle that would otherwise be disposable. When a bottle is reusable, cleaning and sanitation are of greater concern, as well as the corrosive effects on surfaces in contact with the water or other liquids inside the bottle, as well as exterior surfaces of the bottle. Thus, such reusable bottles are typically formed of a small subset of materials which are readily sanitizable and which exhibit little or no corrosion when in the presence of water. Such bottle forming materials are also typically selected to avoid degradation when exposed to other common environmental deterioration agents, such as sunlight and mildly acidic liquids. Also, the materials benefit from exhibiting sufficient strength to avoid damage when dropped or otherwise experiencing moderate physical loads.

While glass is readily sanitizable, it can be prone to breakage unless formed of more exotic glass materials. Plastics often do not handle sunlight particularly well and present a concern that chemicals can leach out of the plastic materials into the water over time. Many drinking bottles are formed of stainless steel or aluminum due to the relatively high degree of sanitizability and high strength characteristics of such bottles. Furthermore, such metals undergo little or no corrosion when in common environments encountered by drinking bottles.

The lids for such drinking bottles often utilize threads as a convenient manner for attaching and detaching the lid. Threaded lids are generally effective in attaching and detaching the lid and avoiding spilling of liquids within the bottle, even when the bottle is oriented in a manner that would otherwise cause liquids to escape. A typical procedure when one desires to drink from the drinking bottle involves first removing the lid, such as by unthreading the lid from the neck of the bottle, and then holding the bottle in one hand while holding the lid in the other hand and tipping the bottle to drink from the bottle. Prior art bottles, when cleaned require that the lid be off of the bottle for drying. A need exists for a system to hold the lid off of the opening to keep the lid retained while allowing the bottle to dry.

This drinking methodology is effective when the user has two hands free. However, often a user desires to drink from the bottle when only one hand is free. For instance, when a user is driving a car it is important that the user keep one hand on the steering wheel at all times. For other users a disability may limit or preclude the use of an extra hand. In such instances, once the lid has been removed from the bottle, the user must then find a safe place to put the lid before drinking from the bottle. Then the user must find the lid in this stored location and reattach the lid upon the bottle. This lid storing and finding process can be rather complex, tedious and undesirable, such that a need exists for an improved manner of retaining a lid adjacent the drinking bottle when the lid is not in use closing the drinking bottle.

SUMMARY OF THE INVENTION

With this invention a bottle or other container is provided along with a lid and with a two-part coupling pair assembly associated with the lid and bottle which allow the lid to be retained adjacent the drinking bottle, but spaced from the opening in the neck of the drinking bottle. The drinking bottle typically includes an outer wall extending up from a base to a neck which surrounds an opening. A lid is provided which can selectively close this opening. In one form of the invention this neck is threaded and the lid includes a threaded plug which interfaces with the threads of the opening on the neck to close the bottle when desired.

The coupling pair has two portions including a lid portion and a bottle portion. These coupling pair portions can have a variety of different configurations which are attachable to each other in a removably attachable fashion. In one embodiment these coupling portions include a pair of magnets or one magnet and one ferromagnetic material. Because aluminum, stainless steel, glass, plastics and other materials which often form drinking bottles are not ferromagnetic, the bottle portion is attached (either permanently or in a removably attachable fashion) to the outer wall of the bottle to provide one portion of such a magnetic coupling system. The lid includes a separate magnet or ferromagnetic material so that the lid can be secured to the bottle on a portion of the bottle other than the opening of the neck. In this way, the lid can be conveniently kept adjacent the bottle while the bottle is being used for drinking. The user need not have two hands available, to both hold the bottle and retain the lid, while drinking from the bottle.

Other forms of coupling pairs include quasi-fabric based hook and loop fastener material such as that commonly provided under the trademark VELCRO. As another alternative, a mechanical hook could be provided on the lid and a band which stands off away from the outer surface of the bottle could be provided so that the lid can be hooked over this band. In another embodiment, the bottle portion can be in a band which snaps onto the bottle and with the magnet removably attachable to the lid so that the coupling pair is retrofittable onto an existing bottle and lid with little or no modification required to the bottle and lid itself, such that a retrofit kit can be provided for an unmodified drinking bottle. In a still further embodiment, the bottle itself can be either formed of a ferromagnetic material or at least with a ferromagnetic outer surface or layer on an outside or near an outside of the bottle or other container. In one such embodiment an insulation layer is provided so that an inner layer of one material is provided and an outer layer of a ferromagnetic layer is also provided. For instance, a stainless steel layer would define an inner wall inboard of insulation and an outer wall could be provided formed of a ferromagnetic steel material. Ferromagnetic steels tend to not handle contact with water particularly well (due to rust formation potential), but are suitable for an outer surface when insulation is provided so that a cold temperature of the liquid will not tend to cause condensation on the outer surface of the bottle.

OBJECTS OF THE INVENTION

Accordingly, a primary object of the present invention is to provide a drinking bottle with a lid and which lid can be attached to the bottle in at least two configurations including one configuration which closes an opening in the bottle and a second configuration which retains the lid to the bottle but without blocking the opening in the bottle.

Another object of the present invention is to provide a retrofit kit which can be attached to a bottle and lid to allow the lid to be retained to the bottle in a position other than on the opening of the bottle.

Another object of the present invention is to provide a method for retaining a lid adjacent a portion of the bottle other than an opening in the bottle.

Another object of the present invention is to provide a lid retaining system which includes at least one magnet and a ferromagnetic material which define a lid portion and bottle portion of a coupling pair and a lid and drinking bottle system so that magnetic force can be used to hold the lid to the bottle on a portion of the bottle spaced from an opening in the bottle.

Another object of the present invention is to provide a drinking a bottle with a lid which can be safely used when driving a car.

Another object of the present invention is to provide a drinking bottle which can have a lid removed and retained and a drink provided from the bottle and the lid returned to close the bottle while the user only utilizes a single hand.

Other further objects of the present invention will become apparent from a careful reading of the included drawing figures, the claims and detailed description of the invention.

BRIEF DESCRIPTION OF THE DRAWINGS

FIG. 8 is a full sectional view of a third alternative bottle including a ferromagnetic outer layer with an inner liner and with the lid also shown in section having a magnet thereon so that the lid can be secured to the bottle in a position other than blocking the opening of the bottle.

FIG. 9 is a sectional view of a portion of that which is shown in FIG. 8 taken along lines 9-9 of FIG. 8.

FIG. 10 is a full sectional view of a fourth alternative bottle provided as a modified embodiment of that which is shown in FIG. 8 with an insulation layer provided between an outer wall and an inner wall with the outer wall being ferromagnetic and with the lid similar to that which is shown in FIG. 8.

FIG. 11 is a sectional view of a portion of that which is shown in FIG. 10 taken along lines 11-11 of FIG. 10.

DESCRIPTION OF THE PREFERRED EMBODIMENT

Figure 3:
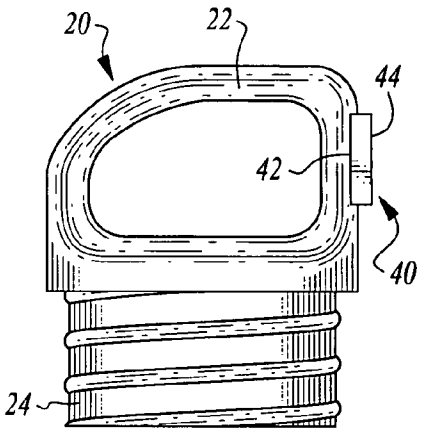
FIG. 3 is a front elevation view of the lid of FIG. 2.
Figure 2:
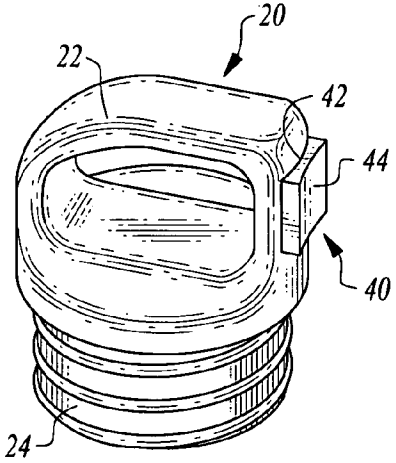
FIG. 2 is a perspective view of the lid associated with the bottle of FIG. 1.
Figure 5:
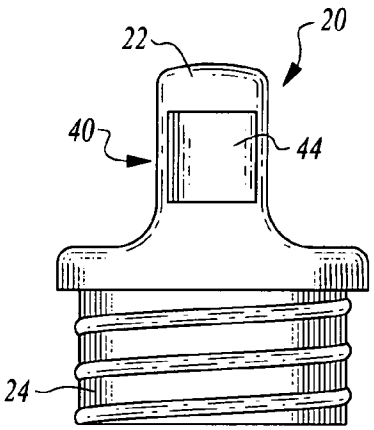
FIG. 5 is a side elevation view of that which is shown in FIG. 2.
Figure 4:
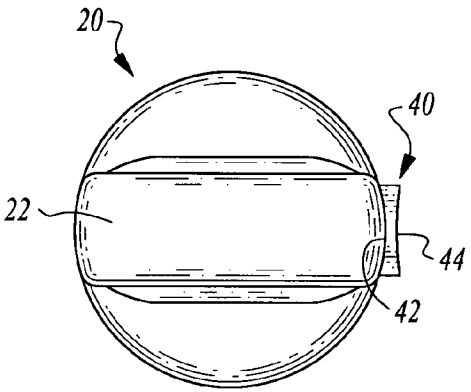
FIG. 4 is a top plan view of that which is shown in FIG. 2.

Referring to the drawings, wherein like reference numerals represent like parts throughout the various drawing figures, reference numeral 10 (FIGS. 1-5) is directed to a drinking bottle which has been modified to include a portion of a coupling pair 30 thereon. The drinking bottle 10 is formed to work complementally with a lid 20. The lid 20 also includes a portion of the coupling pair 30, with such a lid portion 40 and bottle portion 50 of the coupling pair 30 removably attachable to each other. With this invention the lid 20 can be coupled to the drinking bottle 10 in two configurations including one configuration closing an opening into the interior of the drinking bottle 10 and a second retained position leaving the opening open and available for drinking from the drinking bottle 10. Various alternative embodiments of the drinking bottle 10 are shown in FIGS. 6-16 utilizing different attachment methodologies or with different methods for anchoring the coupling pair 30 and alternatives to the coupling pair 30 portions together.

Figure 1:
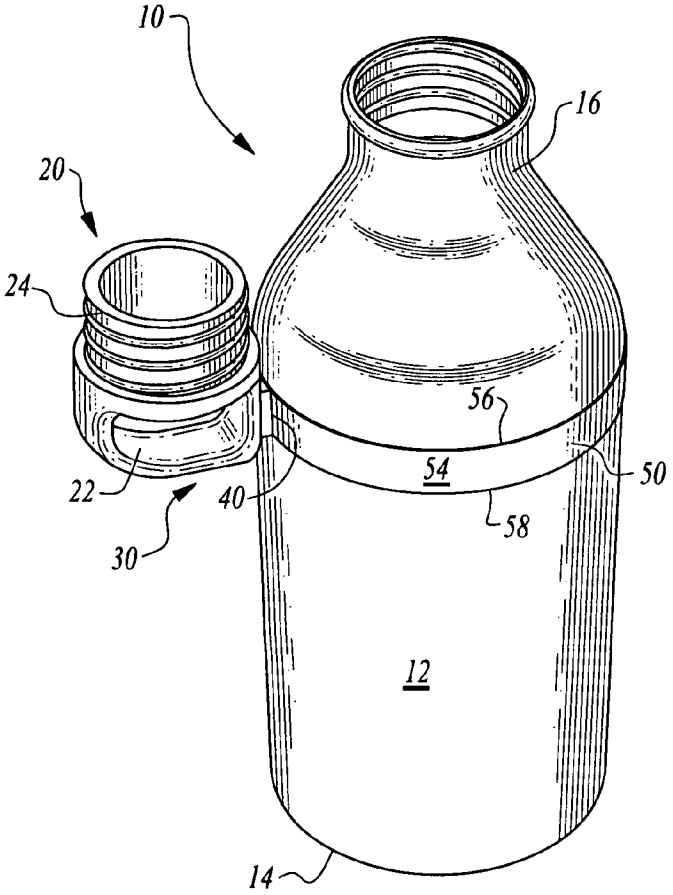
FIG. 1 is a perspective view of a drinking bottle according to a preferred embodiment of this invention with a lid retained to the bottle on a portion of the bottle spaced from an opening in the bottle.

In essence, and with particular reference to FIG. 1, the basic details of this invention are described according to a most preferred embodiment. The drinking bottle 10 defines an enclosure for an interior space which can contain a fluid, such as water or other drinking liquids. An opening is provided into a fluid containing chamber within a bottle 10 through a neck 16 which is typically threaded. The fluid containing chamber is blocked by having the lid 20 fitted within the neck 16. The lid 20 can also be coupled to the drinking bottle 10 through utilization of the coupling pair 30.

The coupling pair 30 includes two portions including a lid portion 40 and a bottle portion 50. The lid portion 40 of the coupling pair is anchored to the lid and the bottle portion 50 is anchored to the bottle. The lid portion 40 and bottle portion 50 can be removably attached together to provide a second methodology for securing the lid 20 in a removable fashion to the drinking bottle 10. In this way, one can remove the lid 20 from the neck 16 and then attach the lid 20 to the drinking bottle 10 before utilizing the drinking bottle 10 for drinking, and without losing the lid 20 or requiring the use of a second hand to hold the lid 20 while drinking.

More specifically, and with continuing reference to FIGS. 1-5, specific details of the drinking bottle 10 and associated lid retainer system of this invention are described, according to this most preferred embodiment. The drinking bottle 10 can have a variety of different configurations but is most preferably of a type having a substantially circular base 14 defining a lowermost portion of the drinking bottle 10 and with a cylindrical outer wall 12 extending up from the base 14. A central axis extends up through the base 14 and through a center of the fluid containing chamber inboard of the cylindrical outer wall 12.

A threaded neck 16 defines an end of the drinking bottle 10 opposite the base 14. This threaded neck 16 typically has a circular cross-section but with a diameter less than that of the base 14 or the cylindrical outer wall 12, such that the cylindrical outer wall 12 tapers below the neck 16 between the diameter of the neck 16 and the maximum diameter above the base 14 but generally similar in diameter to the base 14.

The threaded neck 16 typically has internal threads in the embodiment depicted. However, these threads could be outer threads and the lid 20 could function more as a cap with internal threads that still mate complementally with the threads of the threaded neck 16. Other forms of interconnection means could also be provided for securing the lid 20 to the neck 16 in a manner at least partially closing off the opening in the neck 16. For instance, the lid 20 could snap on.

While this drinking bottle 10 is depicted being cylindrical and having the shape shown, the drinking bottle 10 could have other cross-sectional forms other than cylindrical, it could have a variety of different sizes and shapes. The drinking bottle 10 could also include handles on an outer surface thereof.

In a simplest form of the invention the drinking bottle 10 is formed of a monolithic homogenous material, such as aluminum or stainless steel. As an alternative, the drinking bottle 10 could have various different coatings or layers thereto or be formed as a composite of separate materials.

The lid 20 is preferably formed to include a threaded plug 24 with threads complemental with those of the threaded neck 16. A loop 22 or other grippable portion of the lid 20 is provided on a portion thereof spaced from the threaded plug 24. When the lid 20 includes a threaded plug 24, typically a flange is provided defining a transition between the threaded plug 24 and grippable portions of the lid 20 which can act to further seal an opening in the drinking bottle 10 when the lid 20 is threadably engaged within the opening inboard of the neck 16 of the drinking bottle 10. As an alternative, the lid 20 can be formed more as a cap with internal threads rather than the threaded plug 24.

A coupling pair 30 is provided which joins the lid 20 to the drinking bottle 10. This coupling pair 30 can have a variety of different configurations. In the embodiment shown in FIGS. 1-5, the coupling pair 30 utilizes magnetic force to removably attach the lid 20 to the drinking bottle 10. Because the drinking bottle 10 is typically formed of a non-ferromagnetic material, such as aluminum, stainless steel, plastic or glass, the material forming the cylindrical outer wall 12 of the drinking bottle 10 is not itself sufficiently ferromagnetic to function as a portion of such a coupling pair 30. Thus, a separate lid portion 40 and bottle portion 50 define two parts of the coupling pair 30. These parts could be swapped in orientation, such as with the lid portion 40 including a magnet and the bottle portion 50 being ferromagnetic, or with a bottle portion 50 including a magnet and the lid portion 40 being ferromagnetic.

It is also conceivable that both the lid portion 40 and bottle portion 50 would each be magnets with an orientation which still causes them to attract each other. For instance, the lid portion 40 could have north and south poles on upper and lower sides thereof and the bottle portion 50 could be formed of a series of bar magnets so that when north and south of separate magnets are adjacent each other they are strongly attracted to each other.

Most preferably for simplicity, the bottle portion 50 (which is typically larger) is merely formed of a ferromagnetic band of material. The lid portion 40 is formed of a magnet that can attach to the bottle portion 50 anywhere on the bottle portion 50. In such a configuration, the lid portion 40 includes an anchor surface 42 which is embedded into a portion of the lid 40 or otherwise attached to the lid 40, and an attachment surface 44 opposite the anchor surface 42.

The anchor surface 42 can be attached through use of an adhesive, through use of a fastener, through snapping into a complementally formed recess, through use of a mechanical fastener, or by other means to anchor the lid portion 40 to the lid 20. The attachment surface 44 preferably has a slight curve thereto so that solid surface contact is provided between the attachment surface 44 of the lid portion 40 and the larger radius hoop of the bottle portion 50 on the outer wall 12 of the drinking bottle 10. Alternatively, the surface 44 can be flat.

This bottle portion 50 is preferably in the form of a band having an inner surface adjacent the cylindrical outer wall 12 of the bottle 10 and an outer surface 54 opposite the inner surface. This outer surface 54 is that portion of the bottle portion 50 which comes into contact with the attachment surface 44 so that the lid portion and bottle portion 50 can be coupled together to form the coupling pair 30. This band forming the bottle portion 50 typically has a constant height between a top edge 56 and a bottom edge 58 and a diameter which completely girds the drinking bottle 10.

In one form of the invention, this bottle portion 50 has a diameter which exactly matches a diameter of the drinking bottle 10 or is slightly less than a diameter of the drinking bottle 10, such that a friction fit (or an interference fit) is exhibited between the bottle portion 50 of the coupling pair 30 and the cylindrical outer wall 12 of the drinking bottle 10. As an alternative, the bottle portion 50 could be in a form other than a band and be attached through an adhesive or through other fastening means, and merely be a patch of ferromagnetic material (or a magnet) secured to the cylindrical outer wall 12 of the drinking bottle 10.

Figure 6:
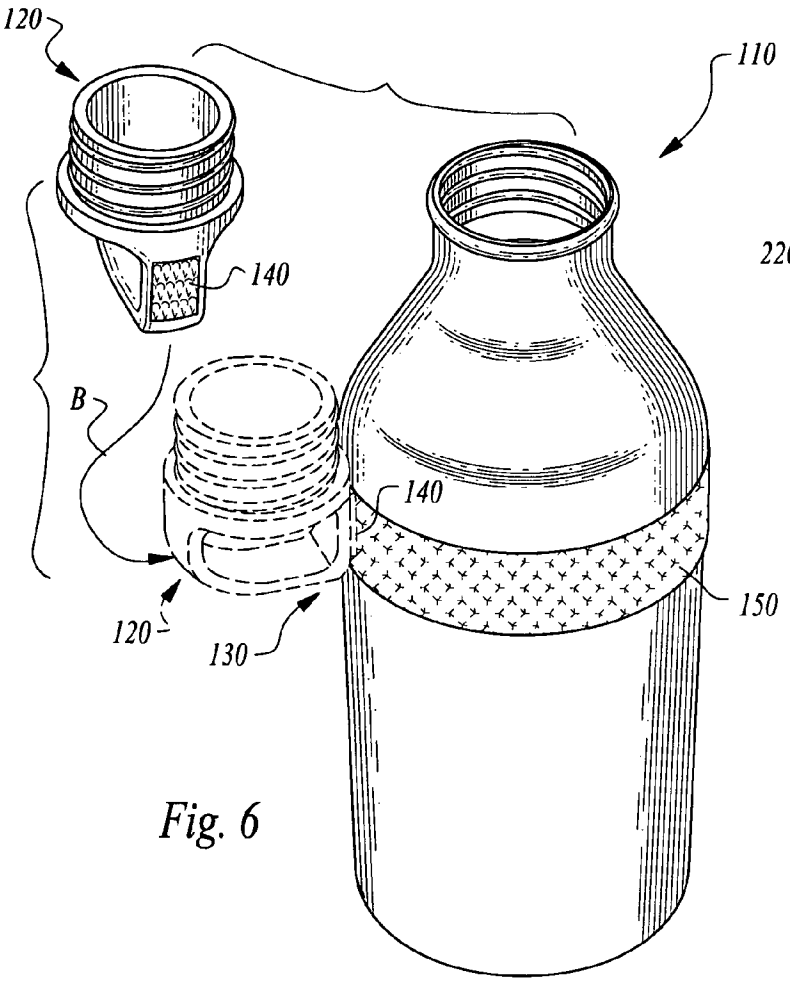
FIG. 6 is a perspective exploded parts view of a first alternative bottle and with an alternative coupling system for attachment of the lid to the bottle.
Figure 14:
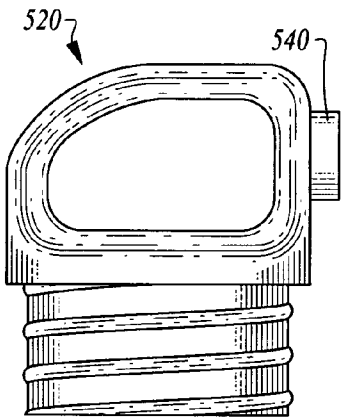
FIG. 14 is a front elevation view of that which is shown in FIG. 13.
Figure 13:
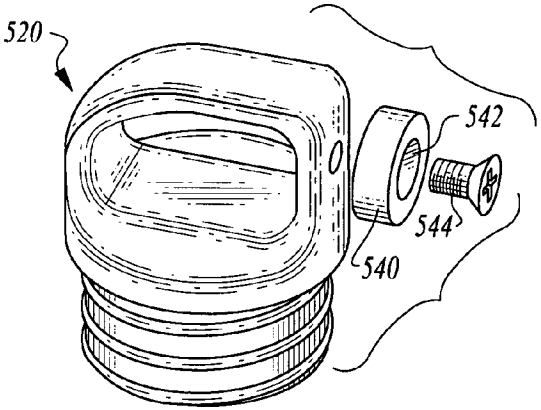
FIG. 13 is a perspective view of the lid of FIG. 12 with a lid portion of a coupling pair in the form of a magnet attachable with a fastener, such as a screw.
Figure 16:
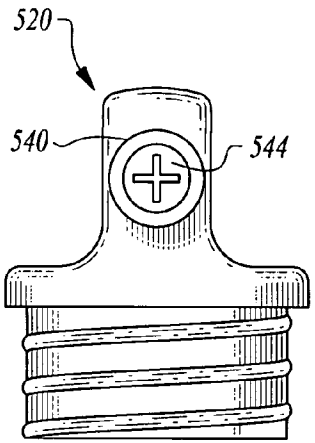
FIG. 16 is a side elevation view of that which is shown in FIG. 13.
Figure 15:
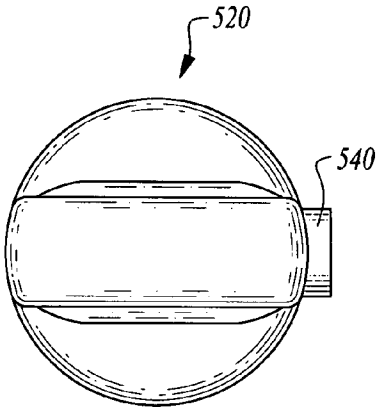
FIG. 15 is a top plan view of that which is shown in FIG. 13.
Figure 12:
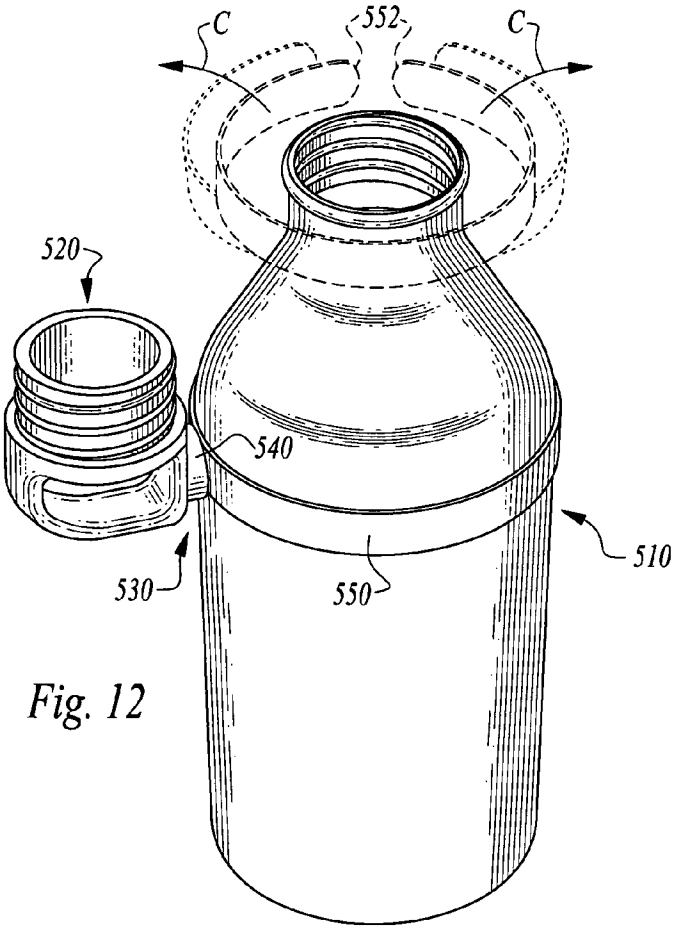
FIG. 12 is a perspective view of a fifth alternative bottle which has had a retrofit kit including a coupling pair in the form of a bottle portion, which is a band which snaps onto the bottle, and a lid portion which is fastenable to the lid so that the lid portion and bottle portion can be retrofitted onto an existing bottle and lid.

With particular reference to FIG. 6, a first alternative bottle 110 is described, according to an alternative embodiment. With this alternative bottle 110, an alternate lid 120 is also provided. An alternate coupling pair 130 is provided including a hook and loop lid portion 140 and a hook and loop bottle portion 150. These portions 140, 150 would have a configuration selected from known prior art quasi-fabric hook and loop fastening systems or other future hook and loop fastening systems developed in the future, many of which such hook and loop coupling systems being known by the trademark VELCRO and provided by Velcro Industries BV of Curacao, Netherlands Antilles. One of the lid portion 140 and bottle portion 150 would include hook material while the other of the portions 140, 150 would include the loop portion. When brought adjacent each other (along arrow B of FIG. 6) the lid 120 would be coupled to the bottle 110 through the bottle portion 150 and the lid portion 140 of the coupling pair 130. The portions 140, 150 would be affixed to the lid 120 and bottle 110, such as through use of an adhesive that bonds more strongly to the lid 120 and bottle 110 than gripping forces existing between the hook and loop material on the lid portion 140 and bottle portion 150. As an alternative, some other form of fastener could be utilized (e.g. mechanical fasteners).

Figure 7:
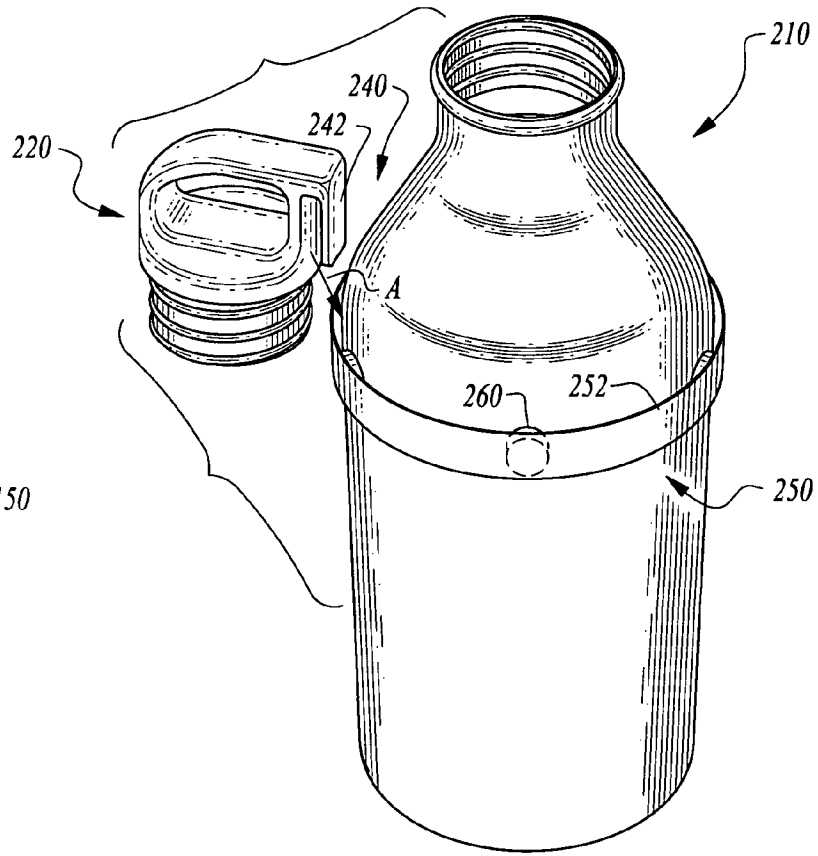
FIG. 7 is a perspective view of a second alternative bottle with a still further alternative coupling system for coupling the lid to the bottle.

With particular reference to FIG. 7, a second alternative bottle 210 is described. This second alternative bottle 210 functions with an alternative lid 240. In particular, the lid portion 240 includes a mechanical hook 242 and the bottle portion 250 includes a band 252. The hook 242 is configured to slide over the band 252 (along arrow A of FIG. 7) which is spaced away from the outer cylindrical wall of the second alternative bottle 210 by standoffs 260. These standoffs 260 can also act to fasten the band 252 to the bottle 210. In both the alternative bottle 110 and the second alternative bottle 210, lids 120, 220 are provided which can attach in two different ways to the bottle 110, 210. In particular, in a first orientation the lid 120, 220 threadably attaches to the bottle 110, 210 for at least partially closing the opening into the bottle 110, 210.

In a second configuration the lid 120, 220 is attached to the bottle 110, 210 for retainment but without blocking the opening into the bottle 110, 210.

With particular references to FIGS. 8 and 9, details of a third alternative bottle 310 are described according to this invention. With this third alternative bottle 310, the bottle portion of the coupling pair is provided as the entire outer surface of the third alternative bottle 310. In particular, an outer layer 312 is provided for the bottle 310 which is formed of ferromagnetic material. A non-magnetic coating, such as paint could be supplied over the outer layer 312, with any such paint or other coating not considered to change the status of the outer layer 312 as the outermost layer of the bottle 310. If the coating is magnetic then it could function as the outer layer 312. A lid 20 (FIGS. 1-5, 8 and 9) can then be attached anywhere on the outer layer 312. An inner layer 313 is preferably provided which acts as a coating for liquids contained within the bottle 310. Such an inner layer 313 would provide a food grade surface and a surface which would not experience rust or other corrosive effects or otherwise interact with the liquid contained within the bottle. Most ferromagnetic materials are not suitable for contact with liquids without experiencing rust, such as typical ferromagnetic steel materials that would typically form the outer layer 312.

With particular reference to FIGS. 10 and 11, a fourth alternative bottle 410 is described. This fourth alternative bottle 410 provides a configuration similar to the third alternative bottle 310 (FIGS. 8 and 9) except that an outer layer 414 is provided outboard of an inner layer 413 and with insulation 415 between the outer layer 414 and inner layer 413. With such insulation 415, the fourth alternative bottle 410 is generally in the form of a thermos which can maintain a temperature of a liquid within the bottle 410. Furthermore, such insulation 415 can isolate the outer layer 414 from the inner layer 413 if these layers 414, 413 are in any way incompatible with each other and best kept from coming into direct contact together (such as undesirable galvanic or corrosion effects), or other chemical reactions taking place between materials forming the layers 414, 413. As with the third alternative bottle 310, the lid 20 of the preferred embodiment (FIGS. 1-5) can be utilized to attach anywhere on the fourth alternative bottle 410 outer surface layer 413.

With particular reference to FIGS. 12-16, details of a fifth alternative bottle 510 are described. With this fifth alternative bottle 510, an unmodified bottle 510 is utilizable according to this invention even though it has no ferromagnetic material or magnets thereon. Furthermore, a standard unmodified drinking bottle lid 520 can be utilized in this embodiment. The coupling pair 530 includes a lid portion 540 in the form of a retrofittable magnet which attaches with a screw 544 passing through a hole 542 in the magnet forming a lid portion 540. Other forms of fasteners other than a screw 544 could be utilized, such as clamps or other mechanical fasteners or an adhesive, so that the hole 542 would not be needed.

With such a retrofit configuration, the lid portion 540 along with a bottle portion 550 of the coupling pair 530 can be provided as a retrofit kit to attach to any existing bottle or lid. The bottle portion 550 of the coupling pair 530 is preferably in the form of a band which is short of a complete circuit where a gap is provided between ends 552. The material forming the bottle portion 550 is substantially rigid but can flex resiliently somewhat (along arrow C of FIG. 12). Dimensions of this band forming the bottle portion 550 are provided with a diameter slightly less than that of the bottle 510 and with sufficient flexibility to flex to match a diameter of the bottle 510 so that the bottle portion 550 can be expanded and snap onto the bottle 510 to hold the bottle portion 550 to the bottle 510.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A drinking container system, comprising in combination:

a container having a fluid containing chamber;

said container having an outer surface surrounding said fluid containing chamber;

said container having a neck with an opening therein providing access to said fluid containing chamber;

a lid adapted to removably attach to said neck of said container to at least partially close said opening in said neck of said container;

a two-part coupling pair including a lid portion that is separate from a container portion;

said lid portion and said container portion of said coupling pair adapted to removably attach to each other;

said lid portion of said two-part coupling pair anchored to said lid;

said container portion of said coupling pair anchored to said container;

said container portion of said coupling pair located on a portion of said outer surface of said container spaced from said opening in said neck;

wherein said lid portion and said container portion include at least one magnet therebetween configured to provide an attraction force between said separate portions of said two-part coupling pair;

wherein said two-part coupling pair includes one magnet and one ferromagnetic material which exhibits an attractive force toward said magnet when placed in proximity to said magnet;

wherein said container portion of said two-part coupling pair includes a band of ferromagnetic material with an outer surface for coupling to said lid portion with said magnet included therewith, said band circumscribing a cylindrical outer wall of said container; and said band having a diameter at least as small as a diameter of said container.

2. The system of claim 1 wherein said container portion includes said outer surface of said container formed at least partially of a ferromagnetic material anchored to other portions of said container.

3. The system of claim 1 wherein said magnet on said lid portion includes a hole passing therethrough and wherein said lid portion includes a fastener sized to pass through said hole in said magnet, said fastener adapted to anchor said magnet to said lid, such that said magnet is affixable to said lid through said fastener.

4. A drinking bottle with retainable lid, comprising in combination:

a bottle having a substantially radially symmetrical form about a central axis;

said bottle including a substantially circular base at a lower end thereof;

said bottle having a neck at an upper end opposite said base;

said neck including an opening therein, said opening aligned with said central axis of said bottle;

said neck of said bottle including threads thereon adjacent a lip of said neck said bottle having a generally conical taper from a cylindrical outer wall defining a greatest diameter of said bottle to a lesser cylindrical form adjacent said neck;

a lid adapted to be removably attached to said neck of said bottle, said lid including a threaded plug with threads formed to threadably engage threads on said neck of said bottle to secure said lid to said bottle and substantially close said opening in said bottle;

a two-part coupling pair including a lid portion that is separate from a bottle portion;

said lid portion and said bottle portion adapted to removably attach to each other;

said lid portion of said two-part coupling pair anchored to said lid;

said bottle portion of said coupling pair anchored to said bottle;

said bottle portion of said coupling pair located on a portion of said bottle spaced from said opening in said neck, such that said two-part coupling pair is adapted to hold said lid to said bottle in a location other than closing said opening in said neck of said bottle to retain said lid when not in use closing said opening in said bottle;

wherein said lid portion and said bottle portion include at least one magnet therebetween configured to provide an attraction force between said separate portions of said two-part coupling pair;

wherein said two-part coupling pair includes one magnet and one ferromagnetic material which exhibits an attractive force toward said magnet when placed in proximity to said magnet;

wherein said bottle portion of said two-part coupling pair includes a band of ferromagnetic material with an outer surface for coupling to said lid portion with said magnet included therewith, said band circumscribing a cylindrical outer wall of said bottle; and said band having a diameter at least as small as a diameter of said bottle.

5. The bottle of claim 4 wherein said band of said bottle portion forms a circuit interrupted by ends adjacent each other and on opposite sides of a gap in said band, said band formed of elastic material adapted to resiliently flex sufficiently to match a diameter of an outer cylindrical wall of said outer surface of said bottle, with said band initially formed with a diameter less than a diameter of said outer cylindrical wall of said outer surface of said bottle.

6. The bottle of claim 4 wherein said cylindrical outer wall of said bottle is formed of a ferromagnetic material and wherein said lid portion includes a magnet therein, such that said lid can be coupled through said lid portion to any portion of said outer cylindrical wall of said drinking bottle and be held in place and said lid is provided with two orientations for affixation to said bottle including through said lid portion of said two-part coupling pair and said threads on said lid mating with threads of said neck of said bottle.

7. The bottle of claim 4 wherein an insulation layer is provided inboard of said outer cylindrical wall of said drinking bottle with a liner inboard of said insulation and defining an interior space within said bottle.

8. The bottle of claim 7 wherein said outer cylindrical wall of said bottle is formed of a ferromagnetic steel material and said inner wall of said bottle inboard of said insulation is formed of a non-ferromagnetic stainless steel material.

9. A method for retaining a lid to a bottle when the lid is not in use closing an opening in the bottle, the method including the steps of:

providing a bottle having a fluid containing chamber, the bottle having an outer surface, the bottle having a neck with an opening therein providing access to the fluid containing chamber, a lid adapted to removably attach to the neck of the bottle to at least partially close the opening in the neck of the bottle, a two-part coupling pair including a lid portion and a bottle portion, the lid portion and the bottle portion of the coupling pair adapted to removably attach to each other, the lid portion anchored to the lid and the bottle portion anchored to the bottle on a portion of the outer surface of the bottle spaced from the opening in the neck;

wherein the lid portion and the bottle portion include at least one magnet therebetween configured to provide an attraction force between the separate portions of the two-part coupling pair, wherein the two-part coupling pair includes one magnet and one ferromagnetic material which exhibits an attractive force toward the magnet when placed in proximity to the magnet, wherein the bottle portion of the two-part coupling pair includes a band of ferromagnetic material with an outer surface for coupling to the lid portion with the magnet included therewith, the band circumscribing a cylindrical outer wall of the bottle and the band having a diameter at least as small as a diameter of the bottle; and placing the lid with the lid portion of the two-part coupling pair in contact with the bottle portion of the two-part coupling pair to hold the lid to the bottle on a portion of the bottle spaced from the neck of the bottle.

10. The system of claim 1 wherein said band has a diameter matching a diameter of said container portion.

11. The system of claim 1 wherein said band has a diameter slightly less than a diameter of said container portion.

12. The system of claim 1 wherein said lid portion includes an attachment surface to which said band can attach, said attachment surface being curved with a curve substantially matching a curvature of said outer surface of said band.

13. The system of claim 1 wherein said lid portion includes an attachment surface to which said band can attach, said attachment surface being substantially flat.

14. The system of claim 4 wherein said band has a diameter matching a diameter of said container portion.

15. The system of claim 4 wherein said band has a diameter slightly less than a diameter of said container portion.

16. The system of claim 4 wherein said lid portion includes an attachment surface to which said band can attach, said attachment surface being curved with a curve substantially matching a curvature of said outer surface of said band.

17. The system of claim 4 wherein said lid portion includes an attachment surface to which said band can attach, said attachment surface being substantially flat.

* * * * *